United States Patent [19]

Gardner, III

[11] 4,039,894

[45] Aug. 2, 1977

[54] ANTENNA LAMP

[76] Inventor: Homer E. Gardner, III, 3212 Fairway Drive, Montgomery, Ala. 36111

[21] Appl. No.: 655,316

[22] Filed: Feb. 4, 1976

[51] Int. Cl.[2] ..... H01K 7/00

[52] U.S. Cl. ..... 315/76; 315/34; 315/344; 343/701; 343/721

[58] Field of Search ..... 343/701, 720, 721, 873, 343/760, 894; 315/34, 76, 344

[56] References Cited

U.S. PATENT DOCUMENTS

| | | | |
|---|---|---|---|
| 1,720,544 | 7/1929 | DeForest | 343/721 X |
| 2,128,750 | 8/1938 | Kriebel | 315/34 |
| 2,189,584 | 2/1940 | Hollmann | 315/34 X |
| 2,252,395 | 8/1941 | Cohen | 343/721 |
| 2,430,664 | 11/1947 | Bradley | 315/34 X |
| 2,744,189 | 5/1956 | Wudyka | 343/721 |

*Primary Examiner*—Saxfield Chatmon, Jr.
*Attorney, Agent, or Firm*—Jones, Tullar & Cooper

[57] ABSTRACT

A lamp for use on a radio antenna is disclosed. The lamp consists of a neon bulb encapsulated in a transparent or translucent covering, with the bulb leads secured in an electrically conductive tube. The tube is adapted for connection to and support by an antenna, whereby the bulb is responsive to RF energy radiated by the antenna to illuminate the lamp.

14 Claims, 3 Drawing Figures

FIG. 1
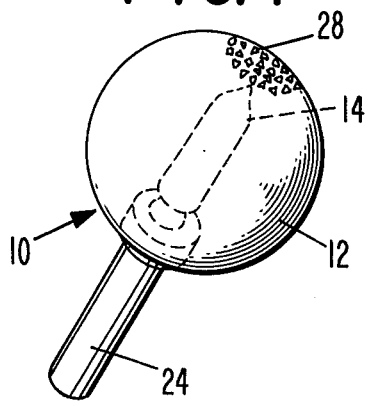
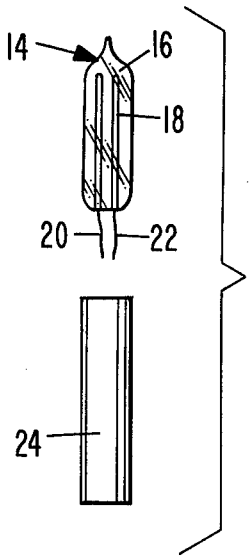
FIG. 2
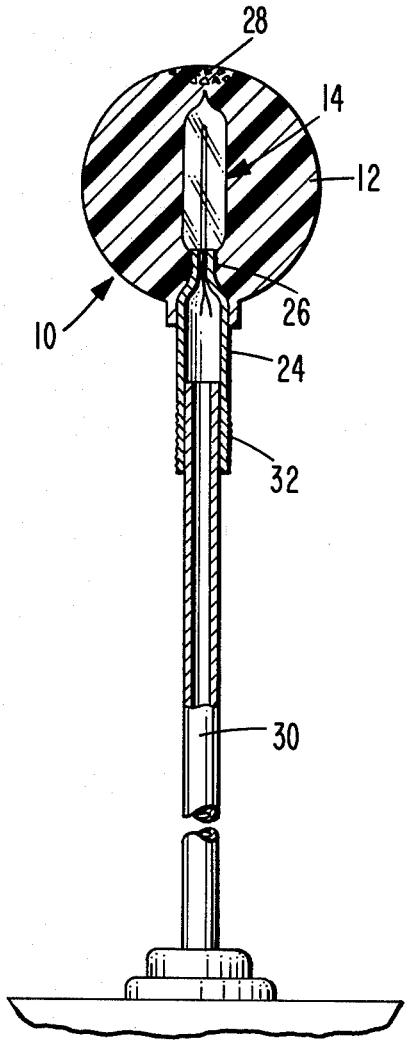
FIG. 3

ANTENNA LAMP

BACKGROUND OF THE INVENTION

The present invention relates, in general, to a lamp for use on a radio antenna, and more particularly to a lamp that is illuminated solely by radio frequency radiation from the antenna.

Although it has been known in the past to combine lamps of various types with antennas, and particularly radio antennas for automobiles, such lamps have principally served a decorative function unrelated to the principle use of the antenna, which is radio communication. While such lamp arrangements serve a useful purpose, they have not been able to solve the problem which applicant has solved in the present invention.

The recent popularity of Citizen's Band radio and the resulting proliferation of radio equipment has produced an explosion in the amount of radio traffic on the various Citizen's Band frequencies, and there is a great deal of concern about methods for reducing this traffic in such a way as to maintain the convenience and usefulness of these radio bands. One of the problems that occurs is that users of such equipment inadvertently leave their transmitters on, causing their equipment to transmit continuously, and cluttering the channel to which the transmitter is tuned. By providing a lamp that may be easily attached to the antenna of a Citizen's Band radio, and which will be responsive to the transmission of the radio frequency (RF) energy, a means may be provided by which the source of such transmissions may readily be determined. Such a lamp provides easy identification of a unit that is transmitting, and this may be a great convenience where several users are operating from the same general area. In addition a lamp of this type will be a popular novelty item for Citizen's Band radio users.

SUMMARY OF THE INVENTION

Briefly, the present invention comprises a lamp which is adapted for mechanical connection to and support by a radio antenna, particularly a transmitter antenna. The lamp includes a neon bulb, a conductive metal tube connected to the electrical leads of the bulb, and an encapsulating cover, or casing surrounding the bulb. One end of the tube is crimped onto the electrical leads of the bulb, and the bulb as well as the crimped connection are encapsulated within a suitable transparent or translucent material. The opposite end of the tube may then be crimped to the end of an antenna, and, it has been found, upon the transmission of RF energy from the antenna, the neon bulb will be illuminated, and the lamp will give off light to provide an indication of the operation of the transmitter.

The bulb may be encapsulated in any suitable material that protects the bulb while permitting the light to be transmitted. Although the preferred form of the lamp incorporates a spherical covering for the lamp, it will be evident that the covering may take many shapes. Similarly, the material preferred for use in the present invention is of a red color for improved visibility, but it may be of any color, or may be clear, as desired. Further, reflective materials such as metallic particles may be embedded in the encapsulating material to enhance the appearance of the device and improve its visibility.

The lamp of the present invention is simple and inexpensive to manufacture and is easily attached to any existing antenna, thus presenting a great improvement over prior antenna lamps not only in function, but in cost, simplicity, and ease of installation.

BRIEF DESCRIPTION OF THE DRAWINGS

The foregoing and additional objects, features, and advantages of the invention will be more clearly understood from a consideration of the following detailed description of a preferred embodiment of the invention, taken with the accompanying drawings, in which:

FIG. 1 is a perspective view of the lamp of the present invention;

FIG. 2 is an exploded view of a portion of the lamp of FIG. 1, and

FIG. 3 is a cross-sectional side view of the lamp of FIG. 1, mounted on an antenna.

DESCRIPTION OF PREFERRED EMBODIMENT

Turning now to a consideration of the drawings, there is illustrated in FIG. 1 a perspective view of one form of the lamp 10 of the present invention, wherein a neon bulb is mounted within, or encapsulated by, a casing 12. The neon bulb, shown at 14 in FIG. 2, is a conventional commercially available bulb, preferably an NE2A1A, having an envelope 16, electrodes 18, and a pair of lead wires 20 and 22. The bulb is mounted on a small metal or metallic tube 24 of a material such as brass, by inserting the lead wires 20 and 22 into the tube and securing them, as by crimping the upper end of the tube in the manner illustrated at 26 in FIG. 3.

After the neon bulb 14 has been attached to the tube 20, the bulb and the crimped end 22 of the tube are encapsulated in the protective and decorative coating or casing 12, which is formed from any suitable transparent or translucent material. The casing 12 is an encapsulating material in which the bulb 14 is embedded, the casing preferably being molded around the bulb and the upper end of the tube 24 into a suitable shape such as the sphere illustrated in the drawings. The casing material preferably is of plastic, for example an acrylic resin such as polymethylmethacrylate, or any other suitable organic thermoplastic or thermosetting resin, or may be of glass or other material which is sufficiently strong to withstand the environmental conditions to which it will be exposed when mounted on the antenna of a mobile radio, and in particular when mounted on a motor vehicle antenna. The casing material must be transparent or translucent so that light emitted by the neon bulb 14 will be transmitted therethrough to be visible at the exterior thereof, and may be of any desired color. Thus, the casing material may contain a suitable dye or other colorant material so that the light emitted from the lamp will be of a desired color. In the preferred form, the plastic is red, since it provides better visibility.

If desired, there may be incorporated into the casing various materials that will serve to modify the pattern of the emitted light. For example, small metallic flakes or particles 28 may be embedded at the top of the spherical casing 12, as shown in FIGS. 1 and 3, to enhance the appearance of the device and to provide reflecting surfaces which create attractive light patterns.

The encapsulating material for the lamp is illustrated in the shape of a sphere, and thus is the preferred form of the invention. However, it will be apparent that other shapes may be used without departing from the present invention.

As shown in FIG. 3, after the lamp has been formed by encapsulating the neon bulb 14 and the upper portion 26 of tube 24 in the plastic material 12, the device is ready to be mounted on a conventional radio antenna 30 of the type used, for example, with Citizen's Band radios and adapted to be mounted on an automobile, truck, or other motor vehicle. The mounting is accomplished by simply inserting the end of the antenna 30 into the lower end of tube 24, and crimping the tube, as generally illustrated at 32. This secures the lamp in place on the antenna, and provides an electrical connection between the antenna and the neon bulb. Accordingly, when the radio connected to the antenna is operated in its transmitting mode, power supplied to the antenna and radiated therefrom supplies power to the neon bulb, illuminating it, and producing light from lamp 10.

Although the present invention has been described in terms of a specific embodiment, it will be apparent that variations and modification can be made without departing from the true spirit and scope thereof as defined by the following claims.

What is claimed is:

1. An antenna lamp responsive to energy radiated from a radio transmitter antenna to produce visible light as a visual indication of radio transmission, comprising:
   a gaseous discharge lamp bulb having electrical lead wire means;
   a metallic tube secured at one end to said lead wire means; and
   encapsulating means encasing said lamp bulb and said one end of said metallic tube, the opposite end of said tube extending from said encapsulating means and being adapted to mount said lamp bulb on an antenna so that energy radiated from said antenna will produce illumination in said lamp bulb to produce light for the duration of such radiation.

2. The lamp of claim 1, wherein said encapsulating means is a solid plastic material in which said lamp bulb is embedded.

3. The lamp of claim 2, wherein said encapsulating means is a translucent, plastic material.

4. The lamp of claim 3, wherein said encapsulating means further includes particulate material for modifying the pattern of light emitted by said lamp bulb.

5. The lamp of claim 3 wherein said lamp bulb is a neon bulb, and wherein said tube is adapted to electrically connect said neon bulb to an antenna, whereby energy radiated from said antenna will be the sole source of enegry for said bulb.

6. The lamp of claim 1, wherein said tube is secured to said lamp bulb lead wire means by crimping, said opposite end of said tube being adapted to be attached to said antenna by crimping to securely mount said lamp to said antenna.

7. The lamp of claim 1, further including antenna means for a radio transmitter, said opposite end of said tube being secured to said antenna whereby said lamp is energized solely by and upon transmission of RF energy from said antenna, and is extinguished upon termination of the transmission of RF energy.

8. The lamp of claim 1, wherein said encapsulating means comprises a casing of solid, translucent, plastic material molded around said bulb, said plastic casing being generally spherical in shape.

9. The lamp of claim 8, further including reflective particulate material embedded in said plastic for modifying the pattern of light emitted by said lamp.

10. The lamp of claim 8, wherein said opposite end of said tube is connectable to an antenna to support said lamp on the antenna, said tube providing an electrical connection between said neon bulb and said antenna so that RF energy applied to said antenna will illuminate said neon bulb to produce light from the lamp as long as said RF energy is applied, thereby providing an indication of RF transmission from the antenna.

11. An antenna lamp responsive to energy radiated from a radio transmitter antenna to produce visible light for the duration of such radiation to provide a visual indication of radio transmission, comprising:
   a gaseous discharge lamp bulb having electrical lead means;
   electrically conductive means secured to said bulb to provide an electrical connection thereto;
   a translucent, plastic casing surrounding said bulb and one end of said conductive means, said bulb and said one end of said conductive means being secured within said casing, the opposite end of said conductive means extending from said casing and being connectable to a radio transmitter antenna to support said lamp on the antenna, said conductive means thereby providing an electrical connection between said bulb and said antenna so that RF energy applied to said antenna will produce illumination in said bulb to produce light from the lamp, the RF energy being the sole source of energization of said bulb.

12. An antenna lamp responsive to energy radiated from a radio transmitter antenna to produce visible light to provide a visual indication of radio transmission, comprising:
   a gaseous discharge lamp bulb; and
   mounting means for mounting the bulb on an antenna, said mounting means including electrically conductive means providing an electrical connection between said bulb and the antenna so that radio frequency energy applied to said antenna will produce illumination in said bulb to produce light from the lamp, the radio frequency energy being the sole source of energization of said bulb.

13. The antenna lamp of claim 12, further including a translucent plastic casing molded around said bulb, and wherein said bulb is a neon bulb.

14. The antenna lamp of claim 13, wherein said mounting means includes an electrically conductive tube secured at one end to said lamp, the other end being adapted to be secured to the antenna for mounting said lamp on the antenna and for providing an electrical connection therebetween.

* * * * *